US006672884B1

(12) United States Patent
Toh et al.

(10) Patent No.: US 6,672,884 B1
(45) Date of Patent: Jan. 6, 2004

(54) POWER CONNECTOR

(75) Inventors: Ser Kiat Toh, Singapore (SG); Aik Leng Ng, Singapore (SG); Thiam Hsin Chia, Singapore (SG); Poh Teck Lim, Singapore (SG)

(73) Assignee: Molex Incorporated, Lisle, IL (US)

( * ) Notice: Subject to any disclaimer, the term of this patent is extended or adjusted under 35 U.S.C. 154(b) by 134 days.

(21) Appl. No.: 09/709,786

(22) Filed: Nov. 3, 2000

(30) Foreign Application Priority Data

Nov. 12, 1999 (SG) ..... 9905636

(51) Int. Cl.[7] ..... H01R 12/00
(52) U.S. Cl. ..... 439/79; 439/947
(58) Field of Search ..... 439/79, 947, 108, 439/607, 609, 610, 80–83, 541.3, 637, 924

(56) References Cited

U.S. PATENT DOCUMENTS

| | | | | | |
|---|---|---|---|---|---|
| 3,864,000 | A | * | 2/1975 | Coller et al. | 439/79 |
| 4,425,015 | A | | 1/1984 | Rizzo | 339/17 |
| 4,697,864 | A | | 10/1987 | Hayes et al. | 439/444 |
| 4,767,342 | A | * | 8/1988 | Sato | 439/79 |
| 5,037,334 | A | | 8/1991 | Viselli et al. | 439/733 |
| 5,104,329 | A | * | 4/1992 | Brown et al. | 439/108 |
| 5,219,295 | A | | 6/1993 | Niwa et al. | 439/79 |
| 5,295,843 | A | * | 3/1994 | Davis et al. | 439/108 |
| 5,378,175 | A | | 1/1995 | Regnier | |
| RE35,159 | E | * | 2/1996 | Brunker et al. | 439/608 |
| 5,490,787 | A | | 2/1996 | Bowman et al. | 439/79 |
| 5,667,411 | A | | 9/1997 | O'Sullivan et al. | 439/701 |
| 5,697,814 | A | | 12/1997 | Delaunay | 439/595 |
| 5,702,257 | A | | 12/1997 | Millhimes | 439/79 |
| 5,820,417 | A | | 10/1998 | Yamada | |
| 5,931,707 | A | | 8/1999 | Ito | |
| 6,217,347 | B1 | * | 4/2001 | Schell et al. | 439/79 |

FOREIGN PATENT DOCUMENTS

| | | | |
|---|---|---|---|
| DE | 3634795 A1 | 4/1988 | H04R/9/09 |
| JP | 7-169532 | 7/1995 | H01R/13/648 |
| JP | 8-298167 | 11/1996 | H01R/13/658 |
| JP | 10-50413 | 2/1998 | H01R/13/658 |

OTHER PUBLICATIONS

Australian Search Report, dated Jun. 28, 2002, mailed by Intellectual Property Office of Singapore to Applicant's Agent on Aug. 5, 2002.

* cited by examiner

*Primary Examiner*—Jean Duverne
(74) *Attorney, Agent, or Firm*—Robert J. Zeitler

(57) ABSTRACT

An electrical connector includes a dielectric housing of molded plastic material having a plurality of elongated terminal-receiving passages into which a plurality of terminals are inserted through a terminal-insertion face of the housing. At least two of the elongated terminal-receiving passages are adjacent to each other and have elongated side walls providing elongated guide surfaces for inserting the terminals. The elongated side walls of each of the passages is open at a side thereof near the other passage along a substantial length thereof to provide communication between the passages for a single core pin to be used in forming the passages during molding of the housing.

20 Claims, 4 Drawing Sheets

POWER CONNECTOR

FIELD OF THE INVENTION

This invention generally relates to the art of electrical connectors and, particularly, to a connector having a molded plastic housing with a unique configuration for facilitating forming the terminal-receiving passages of the housing.

BACKGROUND OF THE INVENTION

Generally, a typical electrical connector includes some form of dielectric housing mounting a plurality of conductive terminals defining the connecting interface of the connector. Quite often, the dielectric housing is molded of plastic material and includes a plurality of terminal-receiving passages into which the terminals are inserted.

Some connectors of the character described above require long and narrow terminal-receiving passages for receiving long and slender pin-type terminals. Such pin terminals are used in header connectors for mounting on printed circuit boards, for instance. When the housing is molded of plastic material, the long and narrow terminal-receiving passages are formed by core pins of the mold die assembly. Considerable problems often are encountered because the core pins which conform to the shape and dimensions of the long and slender terminal pins are prone to breakage and/or deformation. This invention is directed to solving these problems by providing a unique configuration of the molded dielectric housing of the connector, particularly in the area of the terminal-receiving passages, whereby a single robust core pin can be used to form multiple terminal-receiving passages.

SUMMARY OF THE INVENTION

An object, therefore, of the invention is to provide a new and improved electrical connector of the character described.

In the exemplary embodiment of the invention, the connector includes a dielectric housing of molded plastic material. The housing includes a plurality of elongated terminal-receiving passages extending into the housing from a terminal-insertion face of the housing. In addition, the rear of the housing is extended in a step fashion to correspond with the relative lengths of the horizontal portions of the corresponding terminals. A plurality of terminals are inserted into the passages of the housing through the terminal-insertion face thereof.

The invention contemplates that at least two of the elongated terminal-receiving passages be adjacent to each other and have enclosing elongated side wall means. Each of the two passages is open at a side thereof near the other passage along a substantial length thereof to provide communication between the two passages for a single core pin to be used in forming the two passages during molding of the housing. Therefore, the core pin can be considerably more robust than a core pin for forming a single passage.

As disclosed herein, at least four of the terminal-receiving passages are located in a cluster spaced about an axis generally centrally of the cluster. The elongated side wall means of the passages are open at locations nearest the axis to provide communication between all of the passages in the cluster for a single core pin to be used in forming all four passages during molding of the housing. The passages are shown herein to be polygonal in cross-section, such as rectangular passages. The corners of the passages nearest the axis are open to provide communication therebetween for the single core pin.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
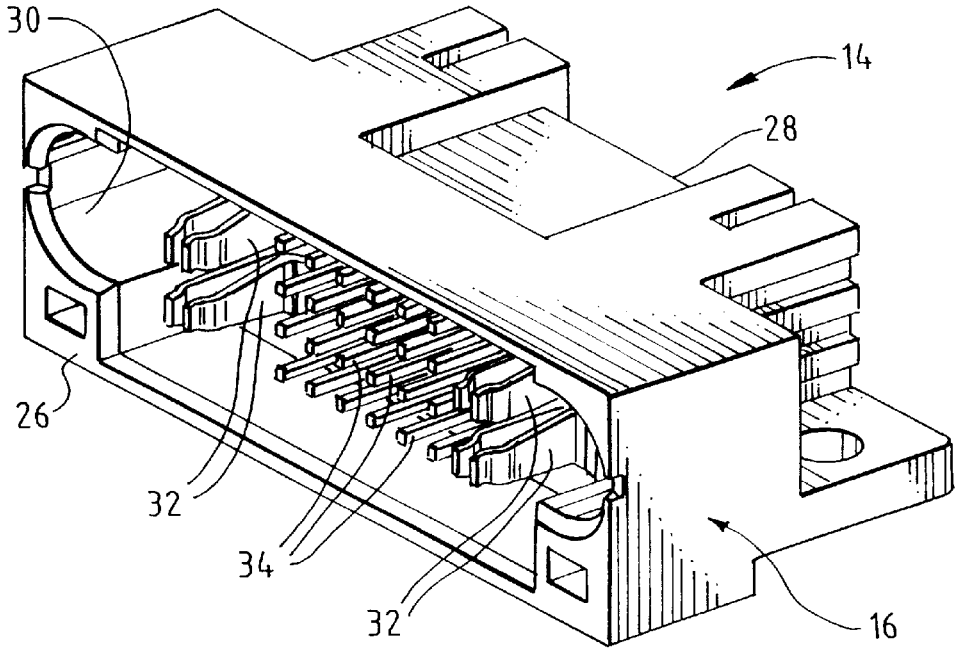
FIG. 1 is a front perspective view of an electrical connector embodying the concepts of the invention.
Figure 2:
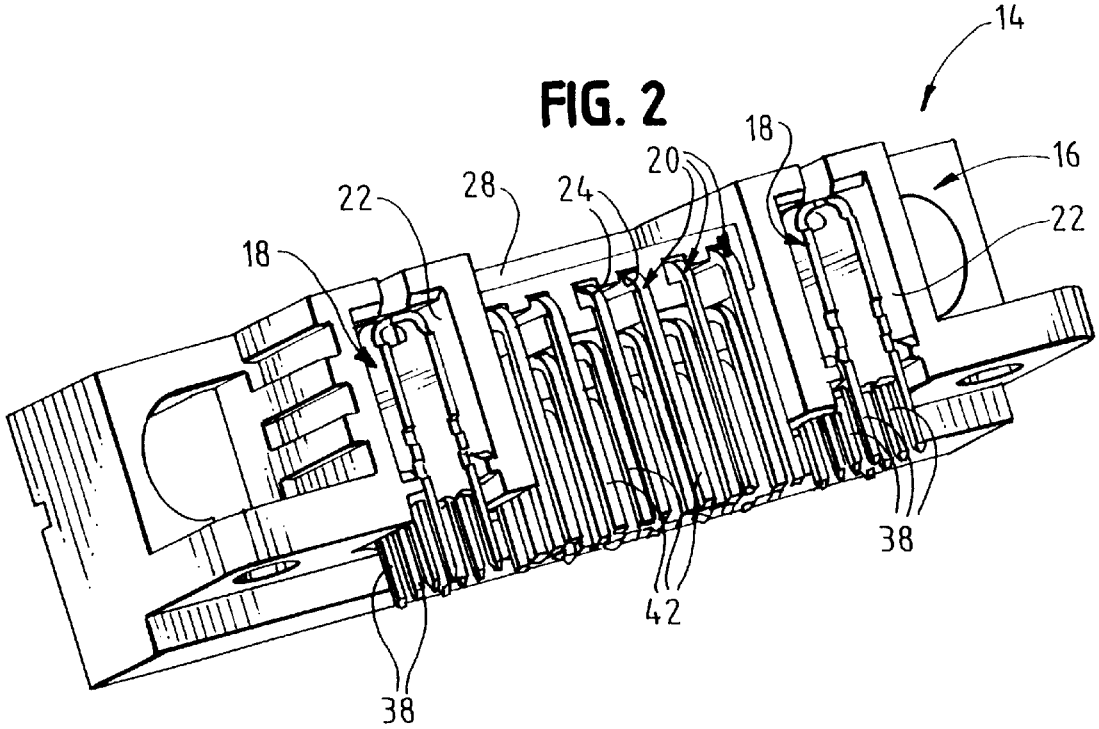
FIG. 2 is a rear perspective view of the connector.
Figure 3:
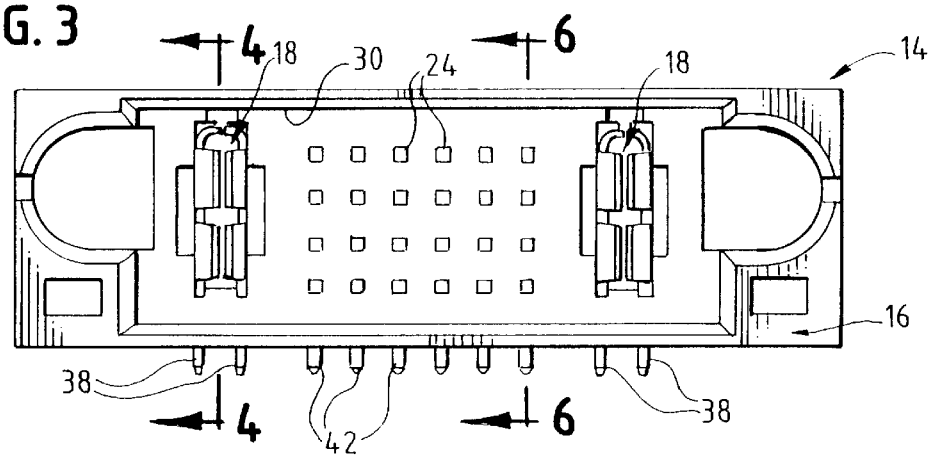
FIG. 3 is a front elevational view of the connector.

Referring to the drawings in greater detail, and first to FIGS. 1–3, the invention is embodied in an electrical connector, generally designated 14, which includes a dielectric housing, generally designated 16, mounting a plurality of terminals which include two power terminals, generally designated 18, and twenty-four signal terminals, generally designated 20. The terminals are inserted into the rear of the housing, with the power terminals being inserted into terminal-receiving passages 22 (FIG. 2) and the signal terminals being inserted into terminal-receiving passages 24.

Housing 16 of connector 14 includes a front mating face 26 (FIG. 1) and a rear terminal insertion face 28 (FIG. 2). The front face of the housing includes a receptacle 30 for receiving a plug portion of a complementary mating connector. As seen best in FIG. 1, contact portions 32 of power terminals 18 and contact pin portions 34 of signal terminals 20 project forwardly of the housing but are disposed within receptacle 30.

Figure 4:
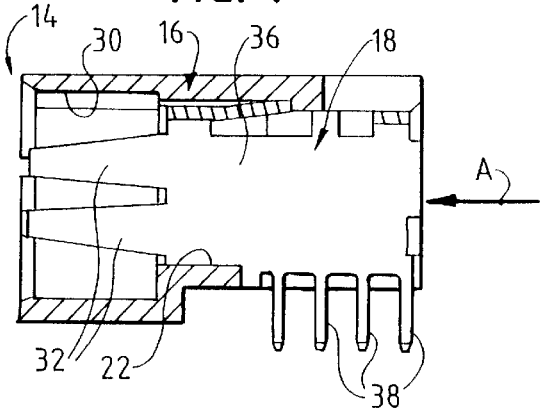
FIG. 4 is a vertical section taken generally along line 4—4 of FIG. 3.
Figure 5:
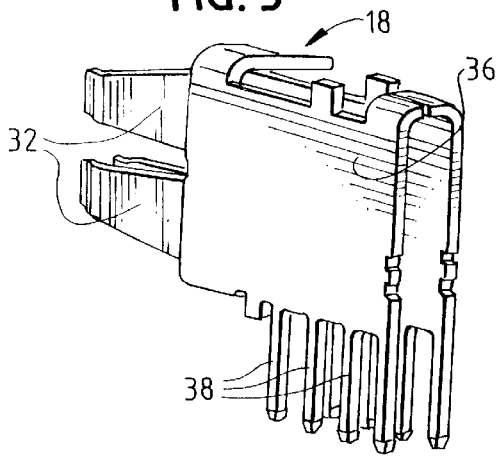
FIG. 5 is a perspective view of one of the power terminals.

Referring to FIGS. 4 and 5 in conjunction with FIGS. 1–3, each power terminal 18 includes an enlarged body portion 36 mounted within a respective one of the terminal-receiving passages 24 in the direction of arrow "A" (FIG. 4). Connector 14 is a header-type connector of a right-angular configuration for mounting on a printed circuit board. Therefore, each power terminal 18 includes a plurality of downwardly extending solder tails 38 for insertion into appropriate holes in the circuit board and for electrical connection, as by soldering, to circuit traces on the board and/or in the holes.

Figure 6:
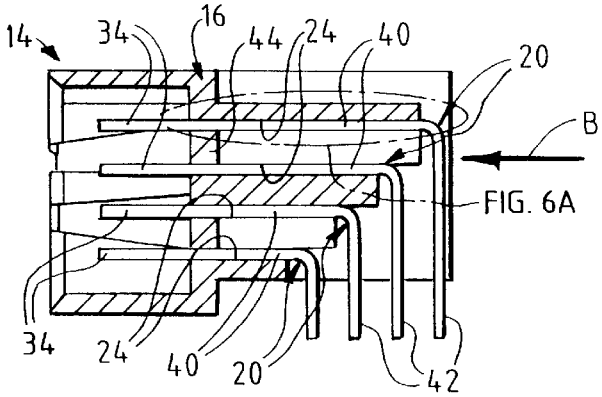
FIG. 6 is a vertical section taken generally along line 6—6 of FIG. 3.

Referring to FIG. 6 in conjunction with FIGS. 1–3, each of the signal terminals 20 is a pin terminal having an L-shaped configuration defined by a horizontal leg 40 and a vertical leg 42. The terminals are inserted into the housing in the direction of arrow "B". As can be seen in FIG. 6, the rear of the housing 16 is extended in a step fashion to correspond to the relative lengths of the horizontal legs 40 of the signal terminals 20. The horizontal legs terminate in contact pin portions 34 projecting into receptacle 30 of housing 16, as described above. Vertical legs 42 comprise solder tails for insertion into appropriate holes in the printed circuit board and for electrical connection to appropriate signal circuit traces on the board and/or in the holes. In comparing FIG. 6 with FIG. 3, it can be seen that there are four horizontal rows of signal terminals 20 and, with the connector being a right-angle connector, the horizontal and vertical legs 40 and 42 of the signal terminals are of different lengths as seen clearly in FIG. 6 so that solder tails 42 can be inserted into four rows of holes in the circuit board.

Still referring to FIG. 6 and the above description, it can be seen that right-angled signal terminals 20 comprise pin terminals having contact pin portions 34 at one end and solder tails 42 at the opposite end. The terminals are polygonal in cross-section, preferably of a square configuration. The terminals are quite small and may be on the order of only 0.64 inch thick. Correspondingly, terminal-receiving passages 24 also must be of a similar small size and configuration for guiding legs 40 of the terminals into the housing. As can be seen in FIG. 6, passages 24 are considerably elongated and very narrow. Finally, FIG. 6 shows that the terminals project through a narrow interior wall 44 of housing 16 and into receptacle 30.

Figure 7:
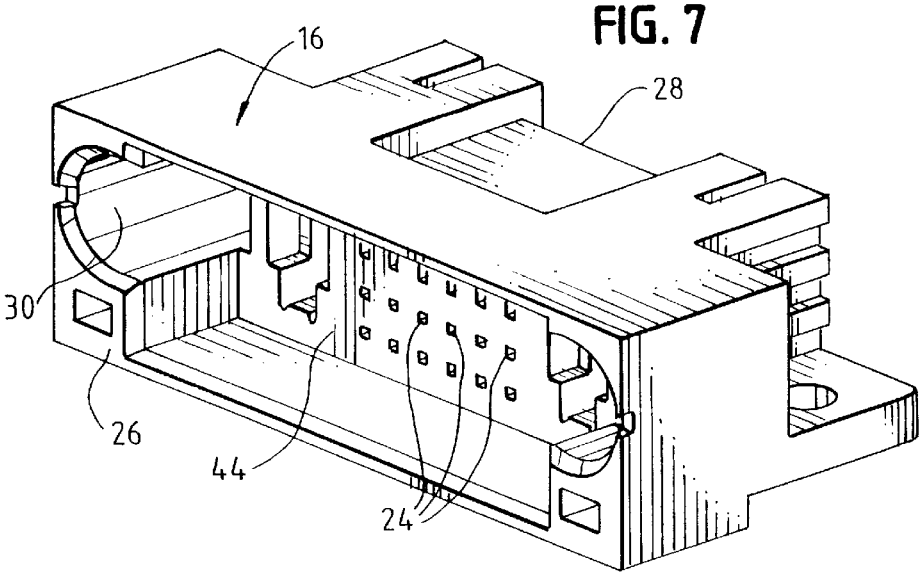
FIG. 7 is a front perspective view of the housing of the connector.
Figure 8:
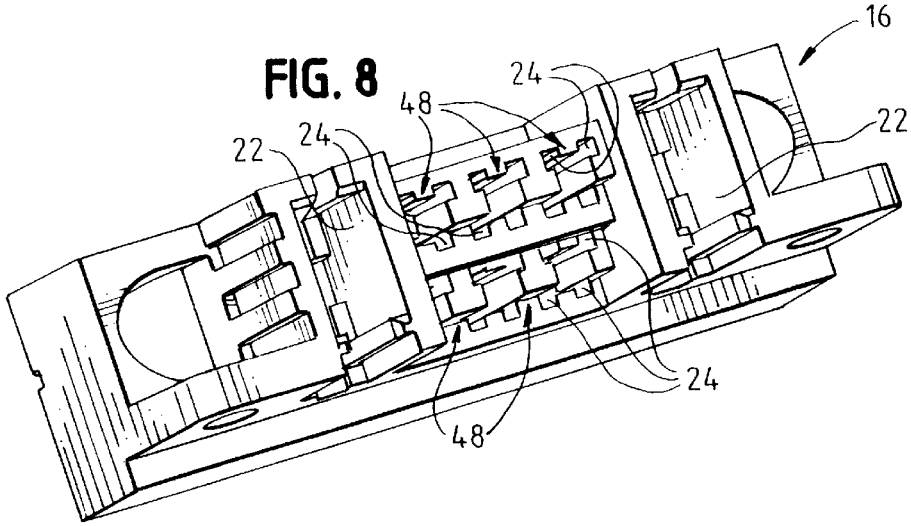
FIG. 8 is a rear perspective view of the housing.
Figure 9:
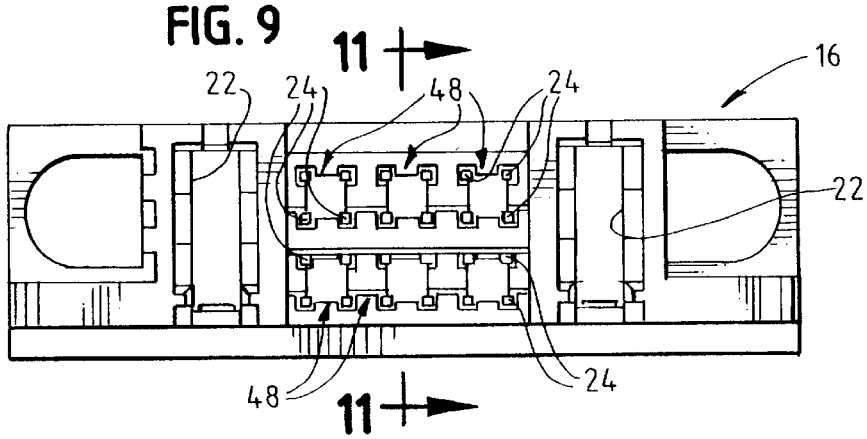
FIG. 9 is a rear elevational view of the housing.

FIGS. 7–11 show housing 16 with the terminals removed to better show the configuration of the area of the housing about and including terminal-receiving passages 24 for signal terminals 20. FIG. 7 shows that the passages 24 are closed on all four sides for short lengths thereof as the passages extend through interior wall 44 (also see FIG. 6) of the housing. FIGS. 8 and 9 show that the passages are arranged in six clusters, generally designated 48, with four passages 24 in each cluster. The four passages define an axis 49 generally centrally of the cluster of passages.

Figure 10:
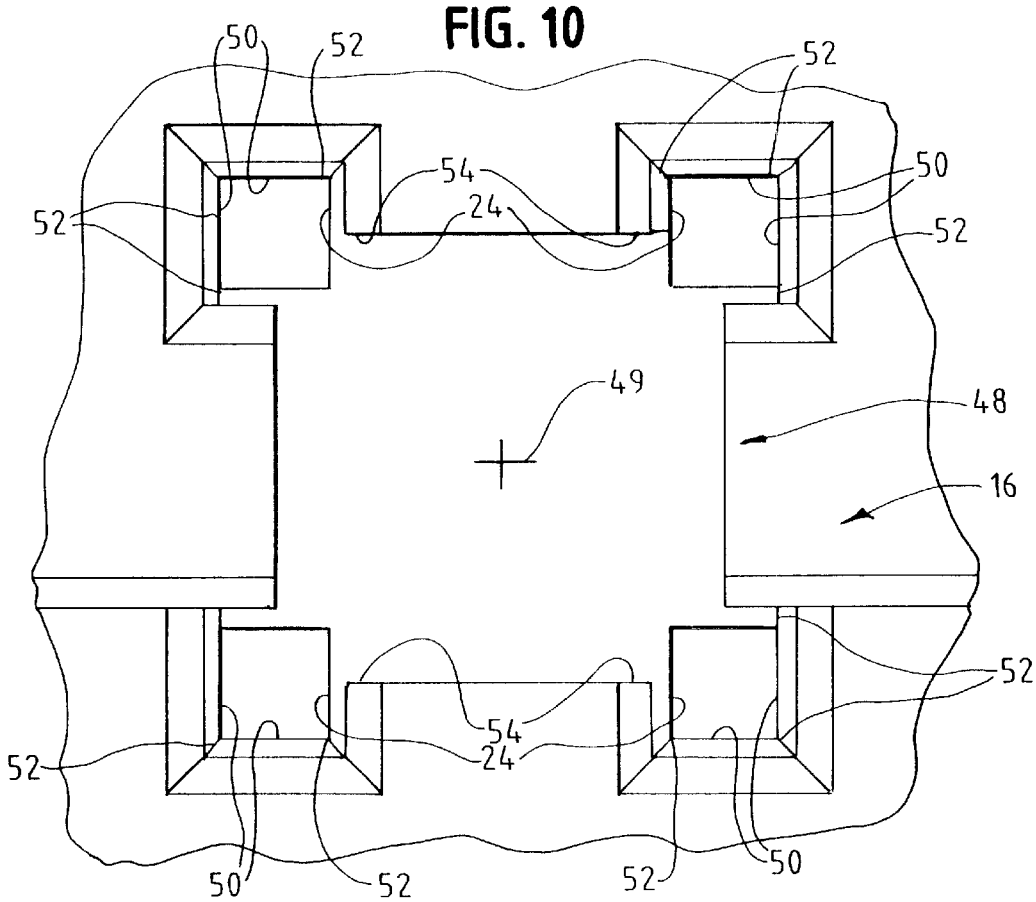
FIG. 10 is a fragmented rear elevational view showing the area of the housing including four of the terminal-receiving passages.
Figure 11:
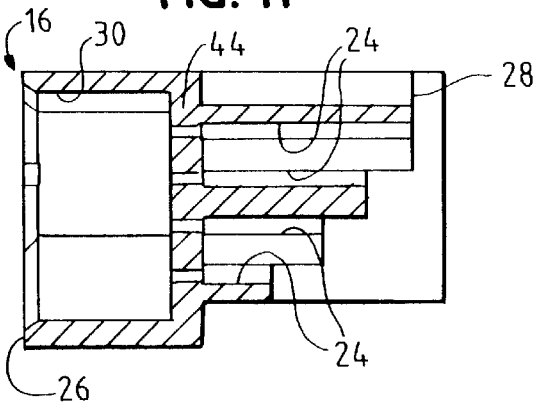
FIG. 11 is a vertical section taken generally along line 11—11 of FIG. 9.

The enlarged depiction of FIG. 10 shows that each square terminal-receiving passages 24 is formed by four side walls 50 which meet at comers 52. The side walls provide guide surfaces for the inserted pin portions 34 of signal terminals 20. However, one of the comers and the adjacent side walls of each passage 24 is open, as at 54. It can be seen that the passages are open at the comers thereof nearest central axis 49. In essence, the major lengths of terminal-receiving passages 24 are in communication through openings 54, except for minor lengths of the passages which extend through narrow interior wall 44 of housing 16.

Figure 12:
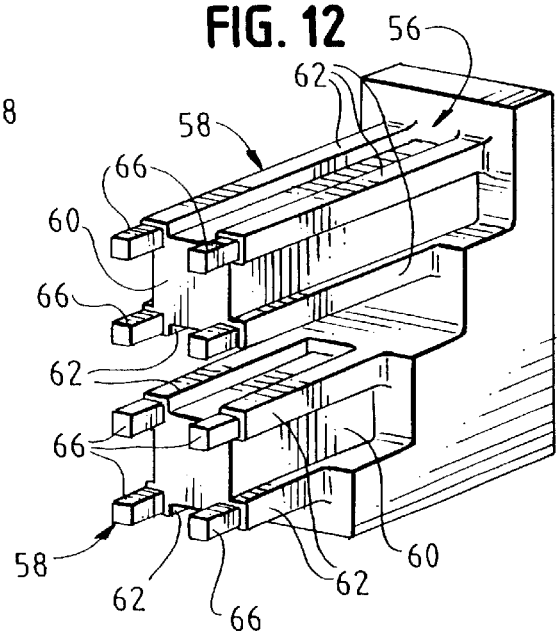
FIG. 12 is a perspective view of a core pin configuration used in forming eight of the terminal-receiving passages in the housing.

FIG. 12 shows a core pin tool, generally designated 56, which includes two core pins, generally designated 58, for forming eight terminal-receiving passages 24 for signal terminals 20. Tool 56 is effective for forming two vertically aligned clusters 48 of four passages in each cluster, as viewed in FIG. 9. Each core pin 58 is effective to form one cluster 48 of four passages 24.

Figure 6A:
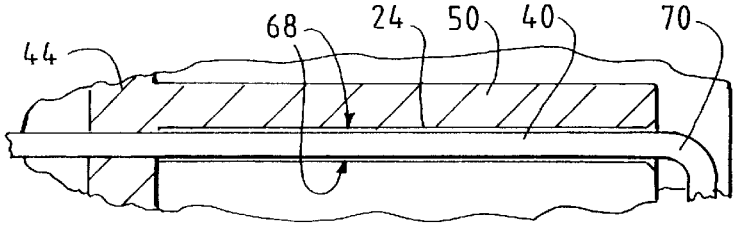
FIG. 6A is an enlarged view of the terminal-receiving passage portion illustrated in FIG. 6.

Specifically, each core pin 58 has a robust body 60 which is square in cross-section, with four square ribs 62 running along the length of the body at the four comers thereof. The ribs are dimensioned to form four passages 24 in one of the clusters 48 of the passages during molding of housing 16. In comparing one of the core pins 58 with the configuration of housing 16 in FIG. 10, it can be seen that body 60 forms an open area 64 within the cluster of four passages 24 and whereby the body can extend through openings 54 communicating with the passages. Ribs 62 of the core pin are integral with robust body 60. Therefore, while the ribs are long and slender to form the long and narrow passages, the ribs are not prone to breakage or deformation because they are rigid with the body. Additionally, ribs 62 are sized to form a clearance zone 68 (FIG. 6A) aft of the interior wall 44 that eases the installation of the signal terminals 20 into the terminal-receiving passages 24. The clearance zone 68 provides a small clearance between the guiding legs 40 and the side walls 50, and the clearance zone 68 allows for guiding of the guide legs 40 of the signal terminals 20, especially toward the rear of the housing near the bend 70 of the signal terminal 20. The end result is better through position control of the horizontal legs 40 during installation of the signal terminals 20 in the housing 16.

Finally, narrow square bosses 66 project lengthwise from the ends of ribs 60 for forming the short portions of the terminal-receiving passages which extend through narrow interior wall 44 of the housing. These bosses are only as long as the narrow thickness of the interior wall and, therefore, are not prone to breakage or deformation. Square bosses 66 are sized to allow for an interference fit of the forward end of the horizontal legs 40 of signal terminals 20 with that portion of the terminal receiving passage 24 at the interior wall 44 of the housing to allow for more rigid retention of the signal terminals 20 within the housing. As the bosses 66 are only as long as the thickness of the interior wall 44, it helps reduce abrasion between the horizontal leg 40 of the signal terminal 20 and the terminal-receiving passages 24 during the signal pin insertion process. Although two core pins 58 (each for forming four passages) are shown on a single tool 56 in FIG. 12, each core pin may comprise its own tool or there may be more than two core pins on a single tool, all depending upon the configuration of the molding die assembly used to mold plastic housing 16.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector, comprising:

a dielectric housing of molded plastic material and including a plurality of elongated terminal-receiving passages extending into the housing from a terminal-insertion face of the housing;

a plurality of terminals inserted into said passages through said terminal-insertion face of the housing; and at least four of said elongated terminal-receiving passages in a polygonal cluster defining an axis generally centrally of the cluster and an opening between said at least four elongated terminal-receiving passages which extends along a majority of a length of said at least four elongated terminal-receiving passages, the cluster defining elongated side walls meeting at corners, the elongated side walls of said at least four elongated terminal-receiving passages being open to said opening at corners thereof closest said axis.

2. The electrical connector of claim 1 wherein said majority of said length of said at least four elongated terminal-receiving passages are in communication with one another through said opening, and wherein a minority of said length of said at least four elongated terminal-receiving passages are not in communication with one another through said opening as said minority of said length of said at least four elongated terminal-receiving passages are completely closed at a mating face of the housing.

3. The electrical connector of claim 1 wherein said terminals comprise elongated pin terminals.

4. The electrical connector of claim 1 wherein said elongated terminal-receiving passages are formed by a core pin during molding of the housing.

5. The electrical connector of claim 1 wherein said housing has a rear portion, said rear portion of said housing being extended therefrom in a step fashion.

6. The electrical connector of claim 5 wherein said housing contains four rows of elongated terminal-receiving passages.

7. The electrical connector of claim 6 wherein said elongated terminal-receiving passages contain signal terminals.

8. The electrical connector of claim 7 wherein said housing contains at least one power terminal passageway.

9. The electrical connector of claim 8 having two power terminal passageways.

10. The electrical connector of claim 9 wherein said signal terminal receiving passages are located between the two power terminal passageways.

11. An electrical connector, comprising:

a dielectric housing of molded plastic material and including a plurality of elongated terminal-receiving passages extending into the housing from a terminal-insertion face of the housing; and at least four of said elongated terminal-receiving passages in a cluster spaced about an axis generally centrally of the cluster and having an opening between said at least four elongated terminal-receiving passages and having enclosing elongated side wall means meeting at corners, the elongated side wall means of said at least four elongated terminal-receiving passages being open to said opening at corners nearest said axis.

12. The electrical connector of claim 11 wherein said elongated terminal-receiving passages are formed by a core pin during molding of the housing.

13. The electrical connector of claim 11 wherein said at least four elongated terminal-receiving passages are polygonal in cross-section.

14. The electrical connector of claim 11 wherein said housing has a rear portion, said rear portion of said housing being extended therefrom in a step fashion.

15. The electrical connector of claim 14 wherein said housing contains four rows of elongated terminal-receiving passages.

16. The electrical connector of claim 15 wherein said housing contains at least one power terminal passageway.

17. The electrical connector of claim 16 having two power terminal passageways.

18. The electrical connector of claim 17 wherein said elongated terminal-receiving passages are located between the two power terminal passageways.

19. An electrical connector, comprising:

a dielectric housing of molded plastic material and including a plurality of terminal-receiving passages extending into the housing from a terminal-insertion face of the housing;

a plurality of terminals inserted into said passages through said terminal-insertion face of the housing; and at least two of said terminal-receiving passages being adjacent to each other and polygonal in cross-section to define side walls meeting at corners, the side walls providing guide surfaces for inserting the terminals, and the side walls being open at one of said corners, the open side walls of at least one pair of adjacent terminal-receiving passages facing each other.

20. An electrical connector, comprising:

a dielectric housing of molded plastic material and including a plurality of terminal-receiving passages extending into the housing from a terminal-insertion face of the housing;

a plurality of terminals inserted into said passages through said terminal-insertion face of the housing; and at least two of said terminal-receiving passages being adjacent to each other and having an opening there between and polygonal in cross-section to define side walls meeting at corners, the side walls providing guide surfaces for inserting the terminals, a majority of a length of said at least two terminal-receiving passages are in communication with another through said opening, and wherein a minority of said length of said at least two terminal-receiving passages are not in communication with one another through said opening as said minority of said length of said at least two terminal-receiving passages are completely closed at a mating surface of the housing.

* * * * *